United States Patent [19]

Takahara et al.

[11] Patent Number: 4,586,015

[45] Date of Patent: Apr. 29, 1986

[54] TRANSFORMER WITH A SURFACE SHIELD LAYER

[75] Inventors: Yasuyuki Takahara; Hirofumi Kubo, both of Nakajomachi; Shigeo Hosaka, Hitachishi; Tomomi Izuna; Toshiyuki Fujimori, both of Nakajomachi, all of Japan

[73] Assignee: Hitachi, Ltd., Tokyo, Japan

[21] Appl. No.: 505,720

[22] Filed: Jun. 20, 1983

[30] Foreign Application Priority Data

Jun. 29, 1982 [JP] Japan ..... 57-110769

[51] Int. Cl.[4] ..... H01F 15/04

[52] U.S. Cl. ..... 336/84 C; 336/69

[58] Field of Search ..... 336/84 C, 84 R, 69

[56] References Cited

U.S. PATENT DOCUMENTS

| | | | |
|---|---|---|---|
| 2,047,159 | 7/1936 | Wood et al. | 336/84 C X |
| 2,088,454 | 7/1937 | Whisk | 336/84 C X |
| 4,305,115 | 12/1981 | Armitage | 336/84 C X |

FOREIGN PATENT DOCUMENTS

| | | | |
|---|---|---|---|
| 1064623 | 9/1959 | Fed. Rep. of Germany | 336/69 |
| 390500 | 4/1933 | United Kingdom | 336/84 C |

*Primary Examiner*—A. D. Pellinen
*Assistant Examiner*—Derek S. Jennings
*Attorney, Agent, or Firm*—Antonelli, Terry & Wands

[57] ABSTRACT

A transformer having a molded coil which can stably sustain an electric-shock free function for a long period of time. The transformer has a grounded conductive shield layer on the surface of the molded coil. The shield layer is composed of a plurality of segments so that a stable bonding of the shield layer to resin is kept for a long period of time, with the respective segments being grounded by a conductor.

10 Claims, 13 Drawing Figures

TRANSFORMER WITH A SURFACE SHIELD LAYERBACKGROUND OF THE INVENTION

1. Field of the Invention

The present invention relates to a transformer with a surface shield layer which is not dangerous even if a human body touches the surface of a molded coil when the transformer is operating under application of voltage thereto.

2. Description of the Prior Art

As shown in FIGS. 1*a* and 1*b*, a conventional general mold-type transformer includes an iron core 1 and a molded coil 2 combined with the iron core 1. As shown in FIGS. 2 and 3, the molded coil 2 is formed by coating a coil element 3 with an insulating resin layer 4, and the molded coil 2, except for the portions of line terminals 5 and tap terminals 6, is completely insulated. In such a normal mold-type transformer, as shown in an equivalent circuit of FIG. 4, there is present a capacitance C2 between the surface of the resin layer and ground, in addition to a capacitance C1 formed by the insulating resin layer 4 between a coil conductor and a ground. Because of these capacitances, when the mold-type transformer is impressed with voltage, the surface of the resin layer is at relatively high potential, and there is some danger of an electric shock when the human body touches the surface of the resin layer.

In, for example, Japanese Patent Application No. 179670/81, a molded coil with a surface shield has been proposed wherein, as shown in FIG. 5, a surface shield layer 2' is formed such that the surface of an insulating resin layer 4 covering a coil element, except the peripheral portions of the line terminals 5 and tap terminals 6, is flame sprayed with aluminum or zinc to have a shield layer 7 (as shaded) of 20 to 200 μm in thickness which serves as a conductive film. By connecting the shield layer 7 to an earth line 9, the molded coil is kept at zero potential over its substantially entire surface, to thereby to prevent an electric shock.

Although not illustrated in the Patent Application No. 179670/81, a slit 8 (along which no shield layer is formed) is provided at a proper location on the circumference of the surface of the insulating resin layer 4, in order to prevent the formation of one turn of the shield layer 7 on the peripheral surface of the iron core.

A coefficient of linear expansion of the conductive film forming the shield layer is generally different from that of the insulating resin layer of the molded coil. Even when a flame sprayed film made of aluminum or zinc of which the coefficient of linear expansion is $2.3\times10^{-5}$/°C. or $3.3\times10^{-5}$/°C. and approximate to $2.6\times10^{-5}$/°C. of injection resin for the molded coil, for example, New MT resin (trade name) manufactured by Hitachi, Ltd. is used, against a temperature change caused when the current flows through the coil and stops its flow therethrough, the shield layer and the resin layer exhibit different thermal expansions and contractions. When the difference of these expansions and contractions are in excess of a predetermined value, the bonding of the shield layer to the resing layer is broken at the boundary therebetween. During the course of the cooling and hardening of the conductive film immediately after the flame spraying, the temperature on the surface of the conductive film, which contacts air, rapidly drops, while the temperature on the surface of the conductive film, which contacts the resin layer, slowly drops. A difference of the contracting rate between both the sides of the conductive film, resulting from the temperature dropping rate difference, generates in the conductive film a stress to peel the conductive film from the resin layer. For the above reasons, as the surface area of the shield layer is larger, viz. the molded coil is larger in size, the shield layer more readily tends to peel off from the resin layer. Thus, it was difficult to form a stable surface shield layer.

SUMMARY OF THE INVENTION

Accordingly, an object of the present invention is to provide a mold-type transformer with a surface shield layer which keeps a stable bonding force for a long period of time, and is free from the peeling off problem.

Another object of the present invention is to provide a mold-type transformer with a good safety and free from an electric shock.

It may be considered that a magnitude of a stress caused by a difference of the thermal expansion/contraction between the shield layer and the resin layer, which difference is also caused by the temperature change as mentioned above and also the difference in contraction speed on the both surfaces at the time of cooling and hardening of flame sprayed film, is proportional to the size of one shield layer.

In the present invention, a conductive film forming the surface shield layer of the molded coil is divided into a plurality of segments. With this segmentation of the conductive film, the size of one shield layer is effectively reduced, leading to decrease of an absolute value of the expansion/contraction.

With such an arrangement, it can be prevented that the shield layer on the surface of the molded coil is peeled off from the resin layer.

Other objects, features and advantages of the invention will be better understood from the following description in connection with the accompanying drawings.

DETAILED DESCRIPTION

Conventional methods for forming a conductive film for shielding the surface of the resin of a molded coil, are those of coating, plating and flame spraying of conductive material. The flame spraying of zinc will exemplarily be described.

Figure 6:
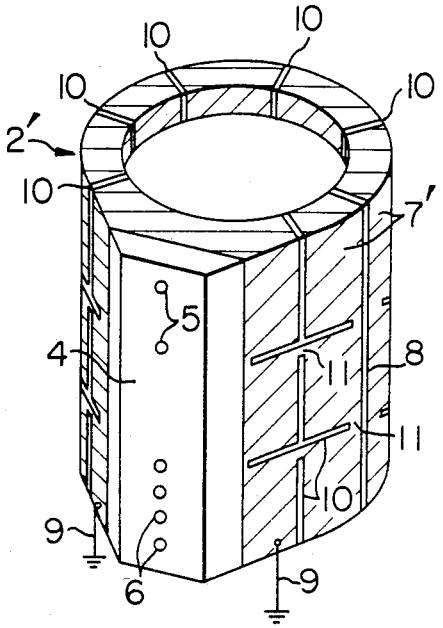
FIG. 6 is a first embodiment of the present invention.
Figure 7:
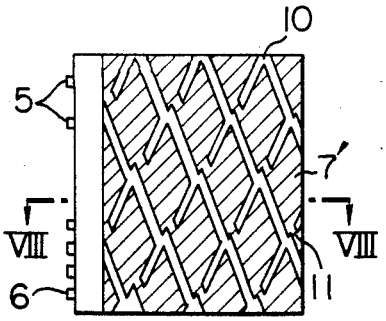
FIG. 7 is a side veiw of a molded coil which is a second embodiment of the present invention.

In FIG. 6, these portions on the surface of a resin layer 4 where a shield layer would not be formed, such as the peripheral portions of terminals, a gap 8, and separation bands 10, are previously covered with a masking tape made of glass fiber. After forming a conductive film of zinc of 20 to 200 μm in thickness of the resin layer 4 by using a zinc flame spraying apparatus, the masking tape is peeled off from the resin layer 4. A shield layer (as shaded) 7', segmented by the gap 8 and the separation bands 10, is formed on the surface of the resin layer 4 of the molded coil except the peripheral portions of line terminals 5 and tap terminals 6. The gap 8 perfectly separates the shield layer 7' on at least one location on the periphery of the resin layer, in order to prevent the formation of one turn of the shield layer 7' around the iron core, which allows the flow of short current therethrough. Each of the segments of the shield layer 7', which are divided by other separation bands 10, are partially connected, on at least one portion to one another by strip like conductive films 11. With this structure, all the segments of the shield layer 7' are electrically interconnected to one another and grounded together. In this embodiment, the shield layer 7' is divided, by the gap 8 and the separation bands 10, into a total of 24 segments; eight segments in the peripheral direction of the coil ad three segments in the axial direction. In an embodiment of FIG. 7, the shield layer 7' is segmented obliquely. Provision of the shield layer 7' on only the portion to be accessed or directly touched by a human being suffices for prevention of dangerous electric shock. Therefore, it may be possible to omit the shield layer 7' on the center portion of the inner periphery of the molded coil which is inaccessible. In a practical design, it is preferable that the size of one segment of the shield layer 7' is selected depending on the thermal expansion coefficients of the insulating resin layer 4 and the shield layer 7' and the thickness of these layers, and that the width of the gap 8 and that of the separation bands 10 are each selected to such a narrow width as not to degrade the safety.

Figure 1A:
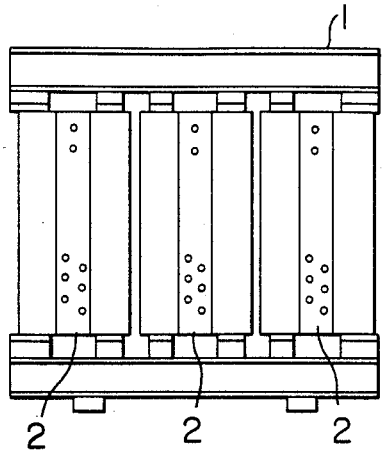
FIG. 1a PRIOR ART
FIGS. 1*a* and 1*b* are a front view and a side view, respectively, of a conventional mold-type transformer.
Figure 1B:
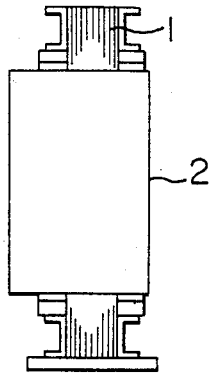
FIG. 1b PRIOR ART
Figure 2:
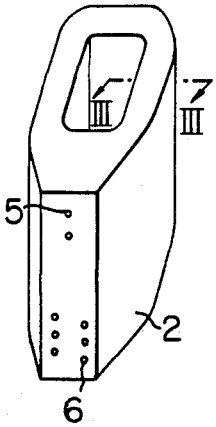
FIG. 2 PRIOR ART
FIG. 2 is a perspective view of a molded coil used in the transformer.
Figure 3:
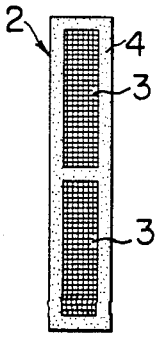
FIG. 3 PRIOR ART
FIG. 3 is a cross sectional view taken on line III—III in FIG. 2.
Figure 4:
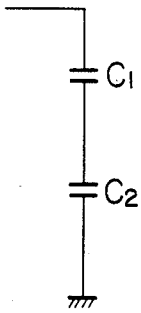
FIG. 4 PRIOR ART
FIG. 4 is an equivalent circuit of the molded coil.
Figure 5:
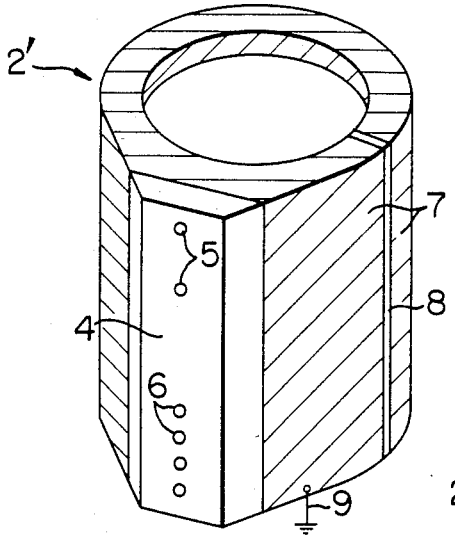
FIG. 5 PRIOR ART
FIG. 5 is a perspective view of a molded coil with a surface shield of the prior art.

The molded coil with a surface shield 2' with such a surface shield is combined with the iron core 1 in the same manner as that of the case of FIG. 1, thereby to form a mold-type transformer. All the segments of the shield layer 7' are grounded in use.

The mold-type transformer with a surface shield thus constructed is featured in that the shield layer 7' on the surface of the molded coil is formed of the conductive film segmented in the peripheral and axial direction of the coil. Because of this feature, a magnitude of a stress caused by a difference of the thermal expansion/contraction between the shield layer 7' and the resin layer 4, which also arises from a temperature change when the current flows through the coil or stops the flow of current, is reduced with reduction of the area of one segment of the shield layer 7'. Further, when the shield layer 7' is formed of a flame sprayed film, an absolute value of a stress caused by a difference of the expanding and contracting rate between both sides when the flame spraying film cools down, while hardening, is likewise decreased, with the reduction of these stresses, the peeling off of the shield layer hardly occurs if one segment of the shield layer 7' is properly sized. If the shield layer 7' is damaged by an external force applied thereto, the damaged portion is relatively easily remedied.

Further, in this embodiment, those respective segments of the shield layer 7' are partially interconnected to one another by the strip like conductive film 11. Therefore, these segments of the shield layer 7' can be considered to be effectively independent of one another. It is noted that the effects of the peeling off prevention effect of the shield layer 7' is further ensured if the strip conductive films 11 interconnecting the segments are displaced so as not to be in a line.

Figure 8:
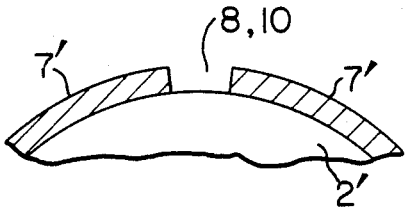
FIG. 8 is a partial cross sectional view taken on line VIII—VIII in FIG. 7.
Figure 9:
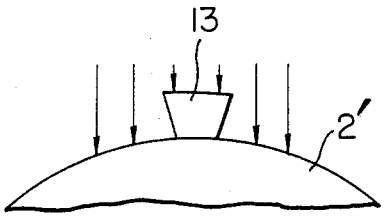
FIG. 9 illustrates a flame spraying state of a third embodiment of the invention.
Figure 10:
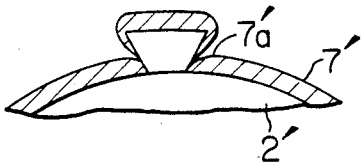
FIG. 10 is a partial cross sectional view of a molded coil of the third embodiment of the invention.

This embodiment uses, for a masking tape, a glass fiber tape capable of withstanding a flame spraying temperature of 420° C. as the melting point of zinc. After the zinc flame sprayed is hardened, the masking tape is peeled off from the resin layer, the edges of the shield layer 7' at the gap 8 and the separation bands 10 are sharply stepped as shown in FIG. 8. This configuration of the edges of the shield layer 7' makes great a potential gradient between edges of the shield layer 7' and the resin surface, and causes a corona discharge to tend to occur. Additionally, the sharp edge is dangerous for persons handling this. In a third embodiment shown most clearly in FIGS. 9 and 10, a masking tape 13 having an inverse trapezoidal cross-section, is applied to the surface of the mold, and is flame-sprayed by metal in the direction of the arrows. In this case, the root of the masking tape 13 is little flame-sprayed by metal, so that each of the edges of the shield layer 7' becomes gradually thinner to the ends, that is to say, the edge of the shield layer 7' is gentle in shape. Therefore, a potential gradient at this portion is small and the edges are not sharp. Accordingly, there is no danger of electric shock if it is touched with the finger and it is difficult for dust to adhere to it. Further, since the edge of the shield layer 7' is tapered, the edges well fit to the resin surface and therefore the shield layer easily follows a deformation and compression of the resin. Therefore, it is difficult for the shield layer 7' to peel off at the edges from the molded coil 2'. Generally, the shield layer 7' begins to peel off at their edges. In this respect, the structure as mentioned above is effective for the prevention of the peeling off of the shield layer 7'. Further, if the inverse trapezoidal tape 13 or a tape much thicker than the shield layer 7' is used for the masking tape, the flame spraying metal and the masking tape 13 easily separate from each other, as shown in FIG. 9. Therefore, when the masking tape 13 is peeled off from the molded coil 2' after the flame spraying, no excessive force is applied to the edges of the shield layer 7', to thereby prevent the peeling off of the shield layer 7'.

Figure 11:
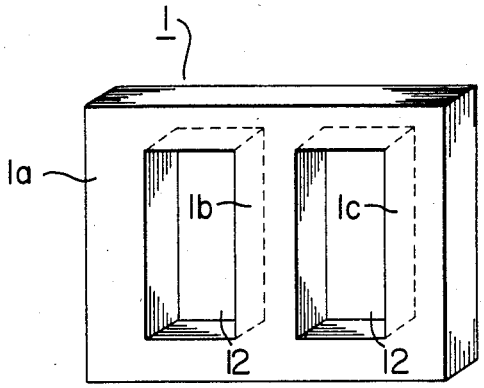
FIG. 11 is a perspective view of an iron core of a mold-type transformer.
Figure 12:
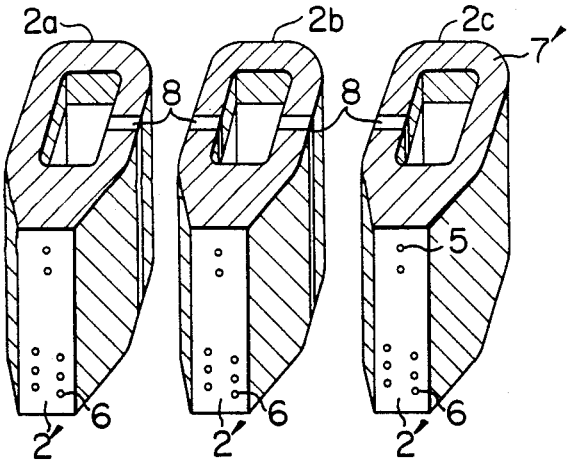
FIG. 12 is a perspective view of a molded coil which is a fourth embodiment according to the present invention.

In the embodiment of FIGS. 11 and 12., the gap 8, shown in FIG. 6, is provided, as a gap to electrically shut off, with a discontinuity in the shield layer 7' in order to prevent the formation of the short circuit for a voltage generated in the shield layer 7' due to an electromagnetic induction originating from the primary winding of the transformer. This structure, however, needs some countermeasure for an electric shortage in the gap 8 which occurs when some metallic member erroneously contacts the coil surface or metallic dust is accumulated in the gap 8 during a long use. As one of the measures for this problem, several gaps 8 must be formed on the coil surface. When this measure is employed, the segments of the metal films separated by the insulating portion must be grounded and this separating work is cumbersome.

The embodiment of FIGS. 11 and 12 is so designed that the gap 8 is provided on the coil surface so that the gap 8 is located inside each of the windows 12 of the iron core 1 when the molded coil is assembled into the transformer iron core. In FIG. 12, there are shown three molded coils 2*a* to 2*c* respectively assembled into the three legs 1*a*, 1*b*, 1*c* of the transformer iron core 1. The gaps 8 of the molded coils 2*a* to 2*c* are formed inside the windows 12 of the iron core 1. Foreign materials hardly enter the inside of the windows 12 of the transformer. Conductive material with a size enough to connect the insulating portions and to short the coil surface, generally does not enter the windows 12, so long as it is forcibly pushed into the window 12. The same thing is true to the insertion of the finger of a human being. This indicates that there is no formation of one turn of the the shield layer 7' with the finger inserted therein and no danger of the electric shock. For this reason, this embodiment can successfully improve a safety and a reliability of the transformer. In FIG. 12, an illustration of the separation bands 10 has been omitted.

As described above, the present invention has successfully provided a safety transformer with a surface shield which effectively prevents the peeling layer of the molded coil and hence ensures an electric-shock free function for a long period of time.

We claim:

1. A transformer having an iron core and a molded coil coated with an insulating resin and disposed in combination with said iron core, wherein a conductive shield layer divided into a plurality of segments is provided on the resin surface of said molded coil except the peripheral portions of terminals and a conductor for grounding the plurality of segments of said shield layer, wherein the edges of the segments of said shield layer are thinner than the remaining portions thereof.

2. A transformer according to claim 1, wherein the plurality of segments of said shield layer are electrically interconnected by a conductive film formed on the resin film of said molded coil and grounded through said conductor.

3. A transformer according to claim 2, wherein a gap with no shield layer is interposed in the plurality of said segments so as not to form one turn of said shield layer around said iron core.

4. A transformer according to claim 2, wherein a gap is formed on the resin surface of said molded coil so as to lie in a window of said iron core.

5. A transformer according to claim 1, wherein a gap with no shield layer is interposed in the plurality of said segments so as not to form one turn of said shield layer around said iron core.

6. A transformer according to claim 1, wherein a gap is formed on the resin surface of said molded coil so as to lie in a window of said iron core.

7. A transformer comprising an iron core, a molded coil disposed in combination with said iron core and coated with an insulating resin having a conductive shield layer coated on an outer surface of said insulating resin and a conductor for grounding said shield layer, said iron core is disposed along an axis of said molded coil and said conductive shield layer is divided into a plurality of segments interconnected by a conductive film formed on the surface of said resin, wherein the edges of the segments are thinner than the remaining portions thereof.

8. A transformer comprising an iron core, a molded coil disposed in combination with said iron core and coated with an insulating resin having a conductive shield layer coated on an outer surface of said insulating resin and a conductor for grounding said shield layer, said iron core is disposed along the axis of said molded coil and said shield layer is provided on the outer surface of said molded coil except at peripheral portions of terminals of the transformer, and an axially extending gap arranged in said shield layer so as to prevent a formation of one turn of said shield layer around said iron core, wherein the edges of the shield layer in said gap are thinner than the remaining portions thereof.

9. A transformer according to claim 8, wherein said gap is formed on the resin surface of said molded coil so as to lie in a window of said iron core.

10. A transformer comprising an iron core having at least one window, a molded coil disposed in combination with said iron core so as to extend through the window of the core and said molded coil being coated with an insulating resin having a conductive shield layer coated on an outer surface of said insulating resin and a conductor for grounding said shield layer, wherein said iron core is disposed along the axis of said molded coil and said shield layer is provided on the outer surface of said molded coil except at peripheral portions of terminals of the transformer, and an axially extending gap is arranged in said shield layer so as to be located inside of said window of said iron core when the molded coil is assembled in the transformer iron core, and wherein the edges of the shield layer in said gap are thinner than the remaining portions thereof.

* * * * *